United States Patent [19]

Harada et al.

[11] Patent Number: 4,472,072

[45] Date of Patent: Sep. 18, 1984

[54] PRINTING APPARATUS

[75] Inventors: Yoshiaki Harada, Neyagawa; Yasuo Nishiwaki, Moriguchi; Yoshihito Urata, Katano, all of Japan

[73] Assignee: Matsushita Electric Industrial Co., Ltd., Osaka, Japan

[21] Appl. No.: 403,878

[22] Filed: Jul. 30, 1982

[30] Foreign Application Priority Data

| | | | |
|---|---|---|---|
| Jul. 30, 1981 | [JP] | Japan | 56-120382 |
| Jul. 31, 1981 | [JP] | Japan | 56-121250 |
| Aug. 1, 1981 | [JP] | Japan | 56-120827 |

[51] Int. Cl.[3] ..... B41J 3/12; B41J 9/24

[52] U.S. Cl. ..... 400/124; 101/93.05; 101/93.34; 400/157.2

[58] Field of Search ..... 400/124, 121, 157.2; 101/93.05, 93.33, 93.34, 93.48

[56] References Cited

U.S. PATENT DOCUMENTS

| | | | |
|---|---|---|---|
| 3,673,955 | 7/1972 | Curtiss et al. | 101/93.48 |
| 3,715,020 | 2/1973 | Nordin | 400/124 |
| 3,830,976 | 8/1974 | Taylor | 400/124 X |
| 4,174,182 | 11/1979 | Lendl | 400/124 |
| 4,264,219 | 4/1981 | Arai et al. | 400/124 X |
| 4,273,039 | 6/1981 | Luo et al. | 101/93.02 |

FOREIGN PATENT DOCUMENTS

| | | | |
|---|---|---|---|
| 2143419 | 5/1972 | Fed. Rep. of Germany | 400/124 |
| 2252767 | 5/1974 | Fed. Rep. of Germany | 400/124 |
| 3017903 | 11/1980 | Fed. Rep. of Germany | 400/124 |
| 3036919 | 4/1981 | Fed. Rep. of Germany | 101/93.04 |

OTHER PUBLICATIONS

*IBM Tech. Disc. Bulletin*, by Applegate, vol. 21, No. 9, Feb. 1979, pp. 3694–3695.

*Primary Examiner*—Paul T. Sewell

*Attorney, Agent, or Firm*—Wenderoth, Lind & Ponack

[57] ABSTRACT

A printing apparatus having a plurality of printing wires or hammers. The printing apparatus has a main drive driven continuously at a resonance frequency so as to supply energy to the plurality of printing wires or hammers, a plurality of selective drives corresponding to the plurality of printing wires or hammers, selectively energized by printing signals so as to transmit the driving energy to the printing wires or hammers. The printer head assembly can be extremely small sized and operate with low energy.

7 Claims, 5 Drawing Figures

PRINTING APPARATUS

BACKGROUND OF THE INVENTION

This invention relates to an impact type printer having a plurality of print wires or hammers. Impact printers are well known in the prior art. As an example, a wire dot matrix printer, a typical impact printer has a plurality of solenoid-driven wires mounted within a movable print head which traverses a paper. During movement of the print head across the paper, selected solenoids are energized and drive the corresponding print wires to impact an inked ribbon and ultimately the paper to form dot-column patterns at closely spaced intervals across the print line. The print head utilizes seven or nine solenoid driven print wires and successively forms five or seven dot column patterns so as to form alphanumeric patterns.

Nowadays wire dot matrix printers are very popular because of their superior characteristics such as simplicity of the mechanism, high speed of solenoid operation, high reliability, and ability to make at the same time. Due to the popularization of readily usable computer systems, dot matrix printers functioning as output apparatus for such computer systems are required to have at least 16 print wires so as to print not only alphanumeric characters but also chinese characters and graphic patterns.

SUMMARY OF THE INVENTION

The present invention seeks to provide a novel and small impact printer having a plurality of printing members and driven by an amount of electric power lower than heretofore achieved in conventional systems. The impact printer of the present invention has a main drive means continuously driven and generates driving power for operation of printing members, and a plurality of trigger driving means selectively energized according to print signals so as to transmit the driving power to the print members to impact the paper.

It is therefore an object of the present invention to provide an impact printer which is small-sized and consumes a small amount of power.

It is another object of the present invention to provide an impact printer which has a main driving means and trigger driving means for driving printing members.

These and other objects, features and advantages of the present invention will become more apparent from considering the following description taken in connection with the accompanying drawings in which.

DETAILED DESCRIPTION OF THE INVENTION

Figure 1:
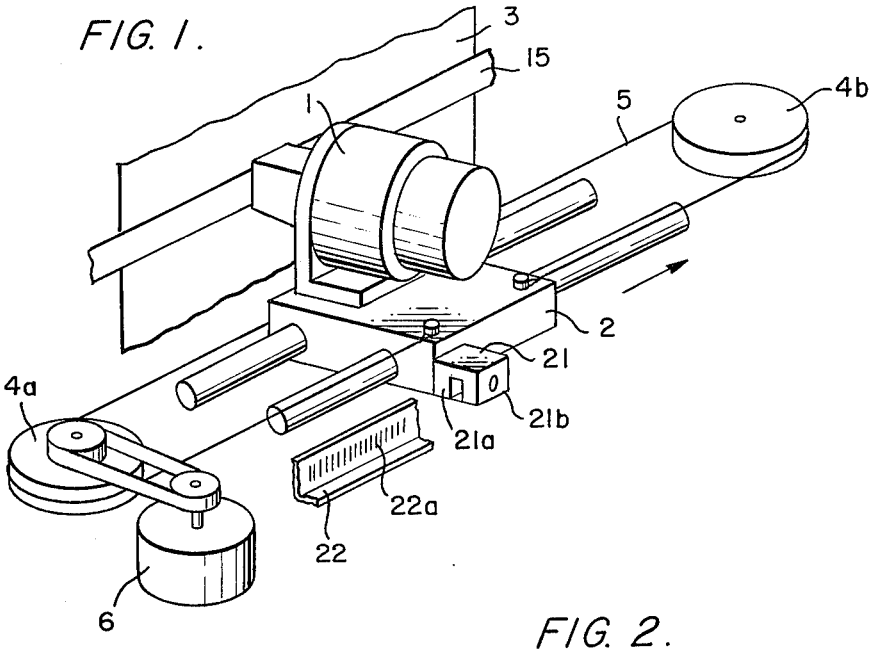
FIG. 1 is a perspective view showing an embodiment of a printing apparatus designed in accordance with the principles of the present invention.

Referring to FIG. 1, a print head assembly 1 is mounted on a carriage base 2 capable of sliding parallel with paper 3. The carriage base 2 is moved parallel with the paper 3 at a constant speed by means of drive pulley 4*a*, idle pulley 4*b* and a drive wire rope 5, the drive pulley 4*a* being driven by a carriage drive motor 6.

Figure 2:
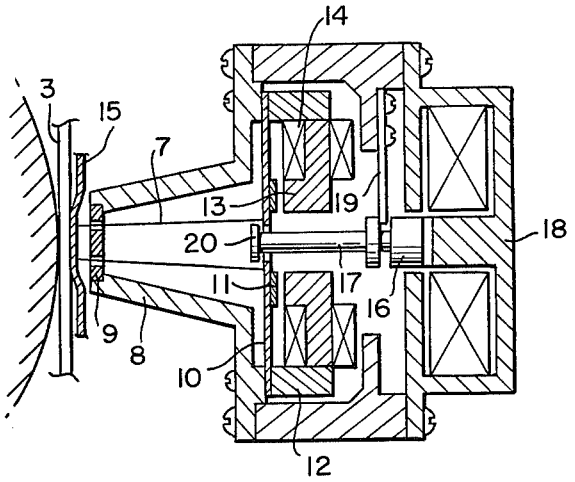
FIG. 2 is a sectional view of an embodiment of a printing head assembly in accordance with the present invention with the printing wires are impacting a paper.

FIG. 2 is a cross-sectional view of the print head assembly 1 showing the internal structure thereof in detail. Print wires 7 are all arranged to converge at the front end of a wire housing 8 and aligned along an imaginary straight line. A jewel bearing 9 is mounted on the front end of the wire housing 8. The jewel bearing 9 has openings corresponding to the print wires 7 for guiding the front ends of the print wires 7. The print wires 7 are slidably supported by the jewel bearing 9 and fixed to print springs 10 at the rear ends, respectively. Each print spring 10 is made of magnetic material and has a magnetic chip 11 on the surface opposite to that to which each print wire 7 is connected. The print springs 10 and magnets 12 are mounted on the inside of the wire housing 8. A trigger yoke 13 made of magnetic material and having a release coil 14 wound therearound has one end fixed to a corresponding magnet 12, and the other end surface faces the corresponding magnetic chip 11 mounted on the corresponding print spring 10 with a gap therebetween.

Each spring 10, magnetic chip 11, magnet 12, trigger yoke 13 and release coil 14 constitute a selective (or trigger) driving mechanism.

Figure 3:
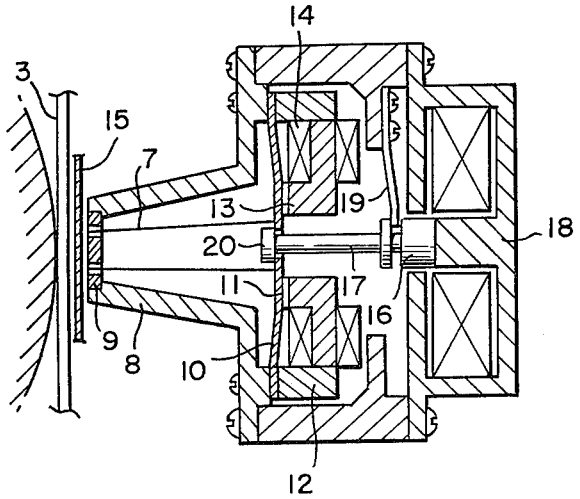
FIG. 3 is a sectional view of the printing head assembly in FIG. 2 when printing wires are not driven.

FIG. 2 shows the print head assembly 1 impacting a ribbon 15 and indirectly the paper 3. An armature 16 carrying a driving member 17 is pulled by a main solenoid 18 mounted on the rear part of the wire housing 8 so as to move the print wires 7 to the reset position. A main spring 19 is mounted on the wire housing 8 for urging the armature 16 to move in the opposite direction it is pulled by solenoid 18. The driving member 17 has a projection 20 at the front end, which catches and pulls the print spring 10 until the magnetic chip 11 contacts with the trigger yoke 13 when the solenoid is energized as shown in FIG. 3.

Armature 16, driving member 17, main solenoid 18, main spring 19 and projection 20 constitute a main driving mechanism.

The ratio of the mass of the print wire 7 and the print spring 10 to the elastic coefficient of the print spring 10 is equivalent to the ratio of mass of the driving member 17 and the main spring 19 to the elastic coefficient of the main spring 19. The main solenoid 18 is energized continuously at the resonance frequency of the vibrating system constituted by the print spring 10 and the print wire 7.

A position sensor 21 comprising a radiant unit 21*a* and a light sensor 21*b* facing each other is mounted on the carriage base 2. A positioning plate 22, having transparent slits 22*a* corresponding to the position where the print wires 7 should be driven to impact, is placed between the radiant unit 21*a* and the light sensor 21*b*.

Figure 4:
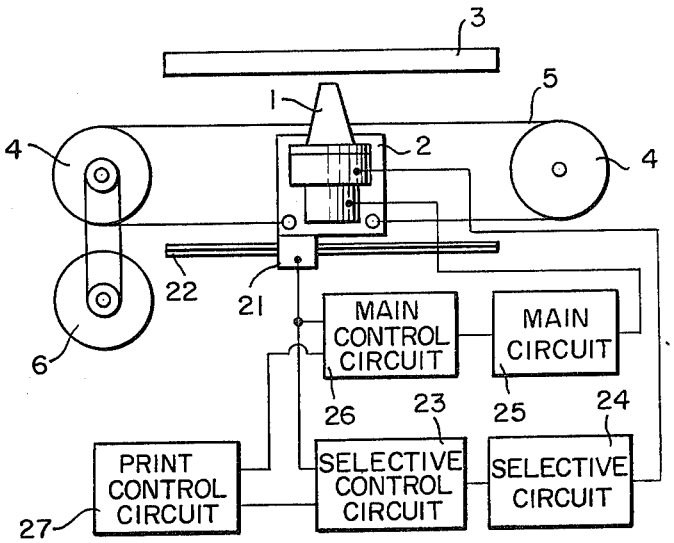
FIG. 4 is a schematic diagram of an embodiment of a printing apparatus in accordance with the present invention.

FIG. 4 is a block diagram of a driving circuit. A selection control circuit 23 delays the time when a selecting circuit 24 energizes the desired release coil or coils 14 until after the time when a main circuit 25 energizes the main solenoid 18. In operation, a main control circuit 26 controls the input voltage to the main solenoid 18 or the time of energization of the main solenoid 18 according to the number of the print wires 7 being driven. The selection control circuit 23 and the main control circuit 26 are not driven by a print signal from a print control circuit 27 until they receive the signal from the position sensor 21.

In the initial condition, all the print springs 10 are held distorted by the force of the magnets 12. The carriage base 2 having the position sensor 21 thereon moves across the paper 3 at a constant speed, so that the position sensor 21 generates a signal at each position where the print wires 7 should be driven. On receiving this signal, the main control circuit 26 and the main circuit 25 energize the main solenoid 18 so as to drive the driving member 17 until the printing spring 19 moves to the reset position where each print spring 10 is held by a magnet 12. The main control circuit 26 controls the duration of the input voltage to the main solenoid 18, i.e. time of enegization of the main solenoid 18, according to the number of the print springs 10 which must be moved so as to be held by the magnet 12 i.e. according to the change of the load.

The vibrating system composed of the driving member 17 and the main spring 19 is driven after a delay time because of the phase delay due to the mass, elasticity and viscosity of the vibrating system. The print springs 10 therefore are moved after a constant time including the delay time so as to move to the reset position. The selecting circuit 24 is energized at a constant time later than the time of energization of the main solenoid 18 by the selection control circuit 23. The selecting circuit 24 sends an electric current to selected ones of the release coils 14 which are required to produce the desired alphanumeric pattern, which cancels the magnetic flux of the magnet 12. Consequently, the attractive force of the magnet 12 is caused to disappear, and the selected print springs 10 are released so that the desired print wires 7 are driven against the paper 3. At this time the main solenoid 18 is no longer energized and the driving member 17 has been driven in the direction toward the paper 3 by the main spring 19.

During the next energization of the main solenoid at the next cycle of the resonance frequency, the main solenoid 18 is energized by the main control circuit 26 and the main circuit 25 so as to move the selected print springs 10 which have driven the selected print wires to the impact position back to the reset position where the print springs 10 are held by the magnets 12.

By the continuous operation as described hereinbefore, the printing apparatus carries out the printing operation.

In the above operation, the amount of electric energy supplied to the release coils 14 is extremely small, being only enough to cancel the magnetic flux of the closed magnetic circuit including: the magnet 12 made of alnico; the trigger yoke 13 made of high permeability material, for example, permalloy; the magnetic chip 11; and the print spring 10, which together constitute a small size trigger unit. Consequently, the main circuit 25 and the power supply unit (not shown) can be small sized, small capacity, and low cost.

Since the main solenoid 18 is capable of being driven continuously in an imaginary constant cycle, it can be driven in the resonance condition despite any variation in the vibrating system due to variations in the number of print wires 7 being driven to impact. This is because, the resonance frequency $f_i$ of the vibrating system comprising the print wire 7 and the print spring 10, assuming that the moving mass and the elastic coefficient of this vibrating system equal to $m_i$, $k_i$, is $$f_i = \frac{1}{2\pi} \sqrt{\frac{k_i}{m_i}} .$$

In the same way, the resonance frequency $f_M$ of the main vibrating system comprising the driving member 17 and the main spring 19 is $$f_M = \frac{1}{2\pi} \sqrt{k_M/m_M} ,$$

where $m_M$, $k_M$ equal the moving mass and elastic coefficient of the vibrating system. The resonance frequency $f_T$ of the total vibrating system when n print wires 7 are driven can be calculated by using the expression $$f_T = \frac{1}{2\pi} \sqrt{\frac{k_M + n \times k_i}{m_M + n \times m_i}} .$$

Thus the relation of each of the vibrating systems $$\frac{k_M}{m_M} = \frac{k_i}{m_i}$$

leads to the relation $$f_T = f_M = f_i = f_d$$

where $f_d$ is driving frequency. Accordingly, the resonance frequency $f_T$ is equal to the driving frequency $f_d$ independently of the number of the print wires 7 being driven to impact the paper 3.

Therefore, the electric power supplied to the main solenoid 18 can be greatly reduced because of high efficiency of the main solenoid as an electro-mechanical transducer. And the delayed time of the movement of the driving member 17 with respect to the time when the electric energy is inputted to the main solenoid 18, decreases, so that the reliability of the printing operation is improved.

The same efficiency is given by the main control circuit 26 which controls the current intensity to the main solenoid 18 or the time of energization of the same according to the number of the print wires 7 being driven to impact the paper 3. And the selection control circuit 23 achieves a high reliability of the printing operation, because the time when the release coils 14 are energized is delayed a constant time including the phase difference between the driving force of the main solenoid 18 and the movement of the driving member 17 with respect to the time when the main solenoid 18 is energized.

In the print head assembly moving across the paper 3 at a constant speed, the main solenoid 18 and the release coils 14 are energized according to the selecting signals at constant intervals generated by the position sensor, so that the dot-pitch error is reduced, and high quality of printed characters is achieved.

Figure 5:
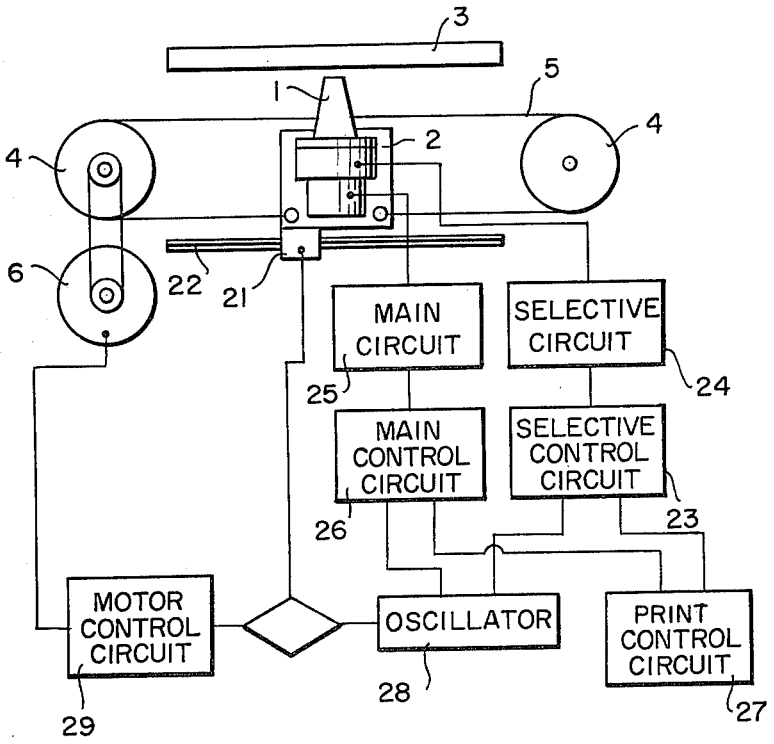
FIG. 5 is a schematic diagram of another embodiment of a printing apparatus in accordance with the present invention.

FIG. 5 shows another embodiment of the driving circuit. The same effect is achieved by the circuit having a standard oscillator 28 and a motor control circuit 29 shown in FIG. 5. The standard oscillator 28 generates pulses at a constant frequency in order to energize the main soleniod 18 and the release coils 14. The motor control circuit 29 controls the carriage motor 6 to synchronize the pulses from the position sensor and a standard pulse.

It can be seen from the foregoing description that the present invention provides a novel impact printer having a plurality of print members comprising a main drive means including the main solenoid, and a trigger (or selective) drive means including release coils so as to achieve a small size printer using only a small amount of energy.

Although this invention has been described with respect to its preferred embodiments, it should be understood that many variations and modifications will now be obvious to those skilled in the art and it is preferred, therefore, that the scope of the invention be limited not by the specific disclosure herein, but only by the appended claims.

What is claimed is:

1. A printing apparatus for use in an impact type printer, comprising:

main driving means having a main driving member which is continuously reciprocated at a constant frequency between a first position and a second position;

a plurality of printing means each having a printing member which is normally in a reset position and is movable from said reset position to a printing position to print; a driving spring engaged with said printing member normally in its distorted position when said printing member is in said reset position and is movable to its undistorted position to move said printing member to said printing position, said driving springs being engaged by said main driving member for being moved from said undistorted position to said distorted position when said main driving member moves from said second position to said first position; and selective driving means including an electromagnet, which normally holds said driving spring in said distorted position by magnetic attractive force sufficient only for such holding and, when a printing signal is supplied to said electromagnet said attractive force is reduced for allowing said driving spring to return to said undistorted position; and a housing in which said main driving means and said plurality of printing means are mounted.

2. The printing apparatus according to claim 1, wherein said constant frequency of the reciprocating movement of said main driving member is equal to the resonance frequency of a vibrating system composed of said printing member and said driving spring.

3. The printing apparatus according to claim 1, wherein said main driving means further comprises a main solenoid which is energized at a constant frequency for reciprocally driving said main driving member from said second position to said first position; and a main driving spring which is fixed at one end to said housing and has the other end engaging said main driving member for driving said main driving member from said first position to said second position.

4. The printing apparatus according to claim 3, wherein the ratio of the mass of a vibrating system composed of said printing member and said driving spring to the elastic ceofficient of the driving spring is equal to the ratio of the mass of a vibrating system composed of said main driving member and said main driving spring to the elastic coefficient of said main driving spring.

5. The printing apparatus according to claim 1, wherein said driving spring is fixed at one end to said housing, and said main driving member has a projection thereon which is engagable with the other end of said driving spring when said driving member moves from said second position to said first position.

6. The printing apparatus according to claim 1, wherein said driving spring has a chip member made of a magnetic material mounted thereon.

7. The printing apparatus according to claim 1, wherein said selective driving means further comprises a permanent magnet for attracting said printing member, and said electromagnet, when said printing signal is applied thereto, produces a magnetic force in a direction opposite to the direction of the attractive force produced by said permanent magnet sufficient to cancel enough of said attractice force so that said driving spring can return to said undistorted position.

* * * * *